US011686078B1

(12) United States Patent
Wescott, Sr.

(10) Patent No.: US 11,686,078 B1
(45) Date of Patent: Jun. 27, 2023

(54) HANDS-FREE TOILET FLUSHING APPARATUS

(71) Applicant: Reginald Wescott, Sr., Philadelphia, PA (US)

(72) Inventor: Reginald Wescott, Sr., Philadelphia, PA (US)

( * ) Notice: Subject to any disclaimer, the term of this patent is extended or adjusted under 35 U.S.C. 154(b) by 0 days.

(21) Appl. No.: 17/935,508

(22) Filed: Sep. 26, 2022

(51) Int. Cl.
*E03D 5/08* (2006.01)

(52) U.S. Cl.
CPC ..... *E03D 5/08* (2013.01)

(58) Field of Classification Search
CPC ..... E03D 5/08; A47K 13/10
See application file for complete search history.

(56) References Cited

U.S. PATENT DOCUMENTS 2,204,867 A * 6/1940 Rehback ..... E03D 5/02 4/249
3,883,904 A 5/1975 Wittman
5,170,513 A * 12/1992 Ambooken ..... E03D 5/08 251/295
5,339,468 A 8/1994 Lin
5,594,958 A 1/1997 Nguyen
6,651,262 B1 11/2003 Tinsley
6,718,562 B1 * 4/2004 Saragas ..... E03D 5/08 4/249
6,968,579 B1 11/2005 Feinberg et al.
7,832,026 B1 11/2010 Bryant et al.
8,214,933 B1 7/2012 Gaudin
8,286,273 B1 * 10/2012 Toomer ..... E03D 5/08 4/246.1
8,495,768 B2 * 7/2013 Owen, Jr. ..... A47K 13/10 4/246.1
9,259,124 B2 2/2016 Wescott, Sr.
(Continued)

FOREIGN PATENT DOCUMENTS

CN 2490228 Y 5/2002
CN 201310121 Y 9/2009
WO 2005110177 A1 11/2005

OTHER PUBLICATIONS

20" RV Camper Toilet Gravity Flush Toilet Foot Pedal White HDPE for Home Caravan Travel Camping, retrieved from the Internet retrieved on Sep. 26, 2022; <URL: https://www.amazon.in/Camper-Toilet-Gravity-Caravan-Camping/dp/B086J365JM>.
(Continued)

*Primary Examiner* — Erin Deery

(57) ABSTRACT

A hands-free toilet flushing apparatus includes a mounting bracket, an input gear assembly, an output gear assembly, a flush pedal, an actuator arm, and a toilet handle connector. The input gear assembly and the output gear assembly are rotatably connected to a wall member of the mounting bracket. The flush pedal is operatively coupled to the input gear assembly, wherein the downward movement of the flush pedal rotates the input gear assembly in a clockwise motion. The output gear assembly is rotatably engaged with the input gear assembly, wherein the clockwise motion of the input gear assembly rotates the output gear assembly in a counterclockwise motion. The actuator arm is operatively coupled to the output gear assembly, wherein the counter-clockwise motion of the output gear assembly applies a downward force to the actuator arm and the engaged toilet handle connector.

18 Claims, 9 Drawing Sheets

(56) References Cited

U.S. PATENT DOCUMENTS

| | | | | |
|---|---|---|---|---|
| 11,118,336 | B1 * | 9/2021 | Alonzo | E03D 5/08 |
| 2014/0090161 | A1 | 4/2014 | Wescott, Sr. | |

OTHER PUBLICATIONS

Hands Free Toilet Flusher, Foot Pedal Toilet Flush Adapter, retrieved from the Internet, retrieved on Sep. 26, 2022; <URL: https://uedata.amazon.com/Hands-Toilet-Flusher-Pedal-Adapter/dp/B0018RVWZ6>.

* cited by examiner

HANDS-FREE TOILET FLUSHING APPARATUS

FIELD OF THE INVENTION

The present invention relates generally to toilet accessories. More specifically the present invention is a hands-free toilet flushing apparatus which adds functionality to any standard toilet that are currently on the market, wherein a foot-operated single pedal system of the present invention allows the user to flush the toilet.

BACKGROUND OF THE INVENTION

Toilets are a cornerstone of human civilization. The toilet allows humans to dispose of bodily waste in a way that is both efficient and sanitary, thus, allowing much higher populations of people to live healthily in a much smaller area than was possible before the advent of the toilet. Although the toilet has greatly improved the sanitation of people relieving themselves, it remains relatively unsanitary by nature of the toilet's intended function; to receive and transport human waste into a septic tank or a sewer system. The presence of a higher concentration of certain bacteria and pathogens, or germs as they are often collectively called, has been a source of some distress for some people. During the course of using a toilet, the user may need to lift either the lid, the seat or both in order to relieve themselves. Then, the user may flush the toilet by pressing the toilet handle. This situation, mainly the pressing of the toilet handle, may be extremely uncomfortable for those people who are concerned about coming into contact with the various bacteria and other pathogens that have a higher saturation in close proximity to toilets.

It is an object of the present invention to create a hands-free toilet flushing apparatus which eliminates the need for a person to touch the toilet handle. The present invention includes a foot-operated single pedal system that allows the user to flush the toilet so that the user never has to touch the toilet handle. Resultantly, the present invention is able to effectively eliminate any transmission of bacteria and pathogens, or germs from the toilet handle to the user.

DETAIL DESCRIPTIONS OF THE INVENTION

All illustrations of the drawings are for the purpose of describing selected versions of the present invention and are not intended to limit the scope of the present invention.

Figure 1:
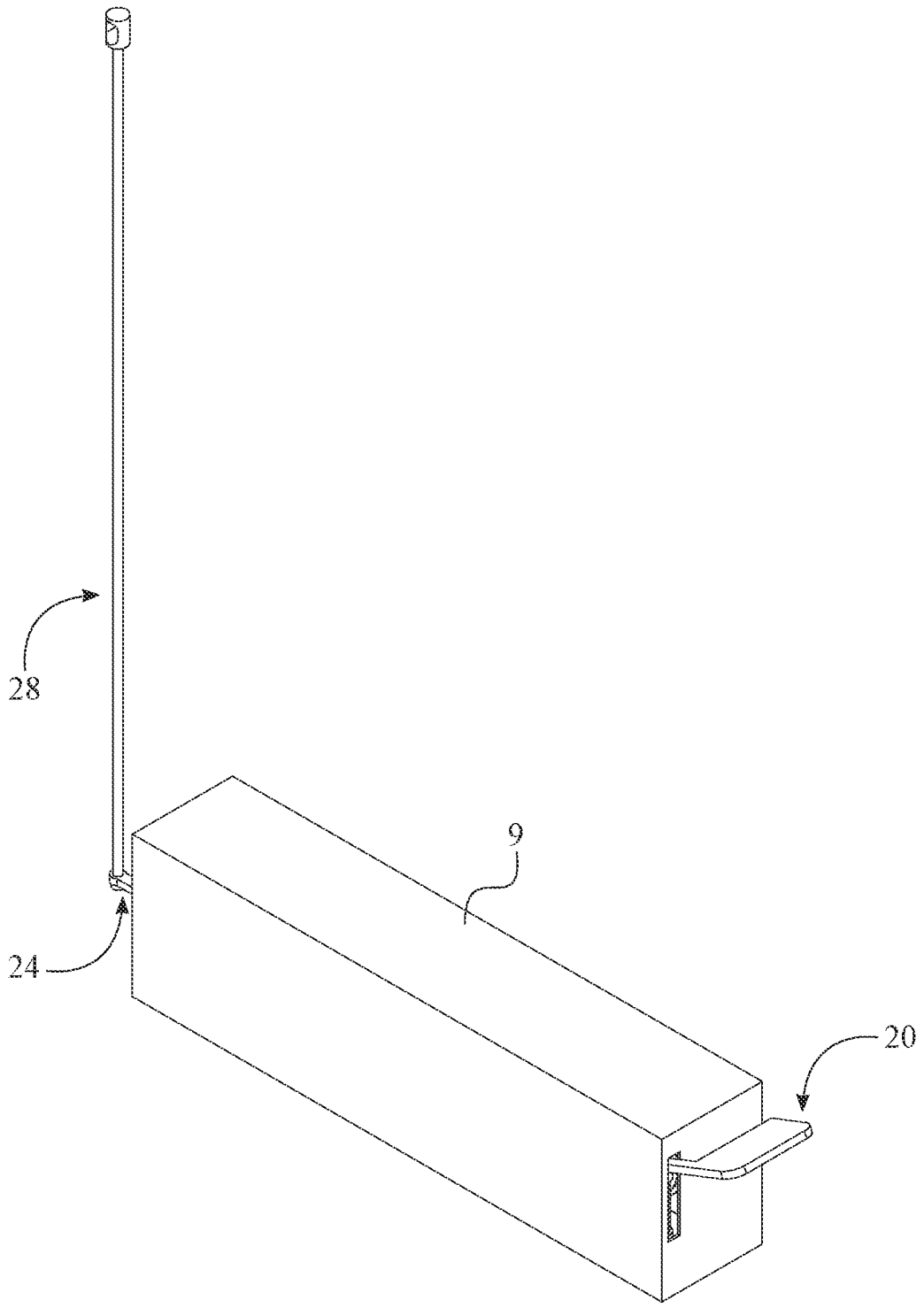
FIG. 1 is a top perspective view of the present invention.
Figure 2:
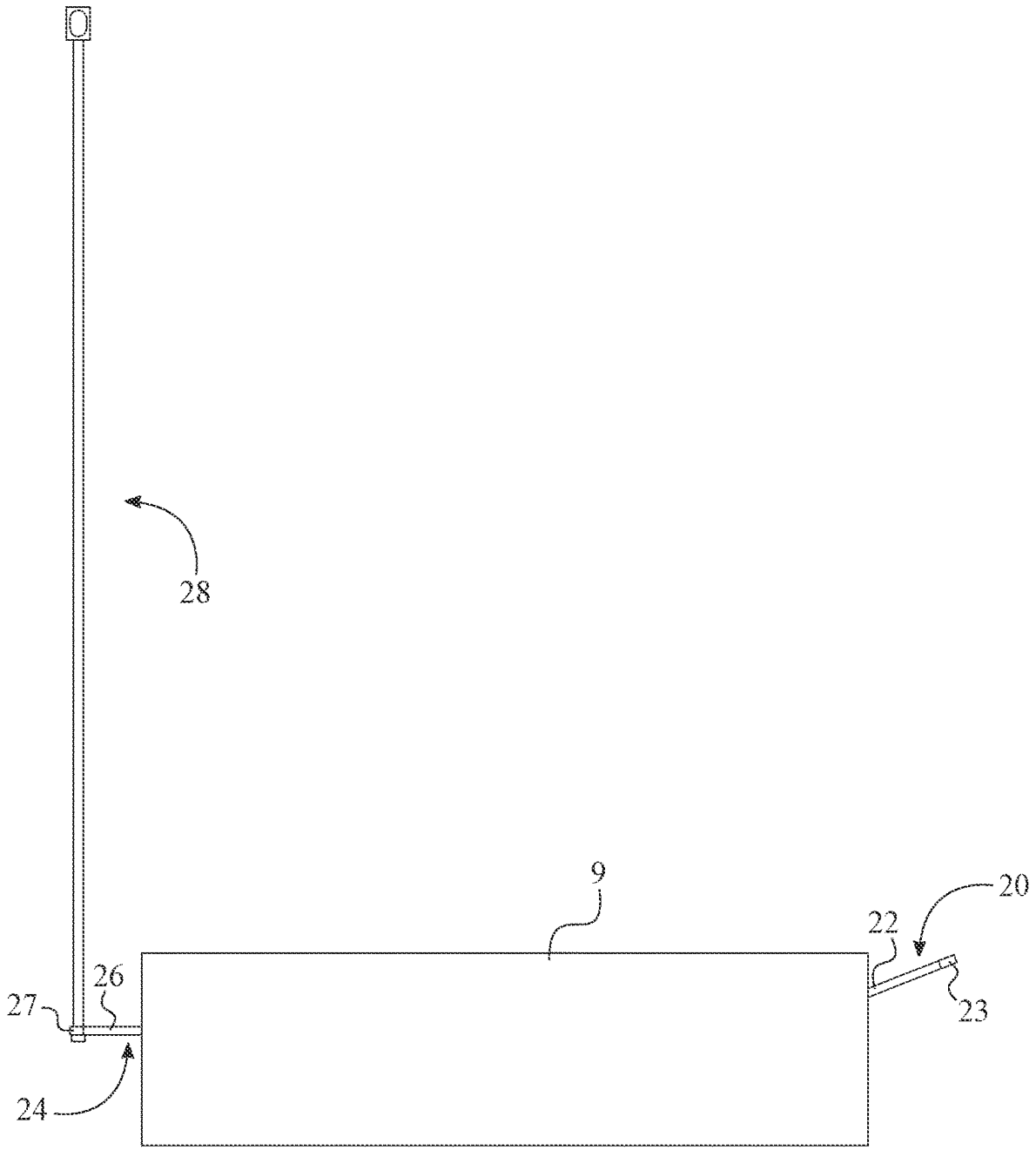
FIG. 2 is a side view of the present invention.
Figure 3:
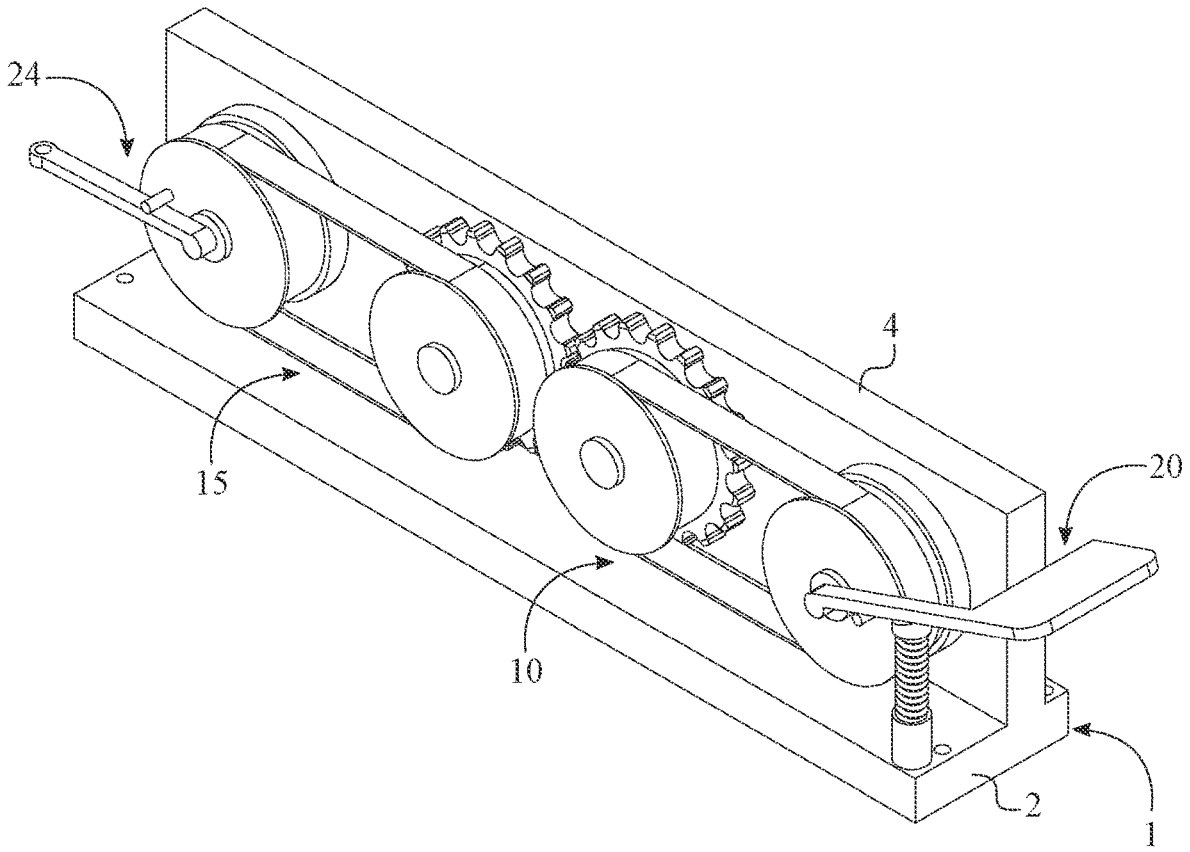
FIG. 3 is a top perspective view of the present invention without the toilet handle connector and the cover.

The present invention is a hands-free toilet flushing apparatus and eliminates the need for a person to touch the toilet handle. More specifically, the present invention is a foot-operated single pedal system and allows the user to flush the toilet so that the user never has to touch the toilet handle. As shown in FIGS. 1-3, the present invention comprises a mounting bracket 1, an input gear assembly 10, an output gear assembly 15, a flush pedal 20, an actuator arm 24, and a toilet handle connector 28.

In reference to the general configuration of the present invention, as shown in FIGS. 1-6 and FIG. 9, the mounting bracket 1 that function as the structural component comprises a base member 2 and a wall member 4. The wall member 4 is perpendicularly connected to the base member 2 thus allowing the base member 2 to be fastened to the bathroom floor. The input gear assembly 10 is rotatably connected to the wall member 4 so that the user can activate the present invention through the flush pedal 20. More specifically, the flush pedal 20 is operatively coupled to the input gear assembly 10 in such a way that the downward movement of the flush pedal 20 is able to rotate the input gear assembly 10 in a clockwise motion. The output gear assembly 15 is rotatably connected to the wall member 4 so that the present invention is able to transform the inputted energy to flush the toilet. More specifically, the output gear assembly 15 is rotatably engaged with the input gear assembly 10, wherein the clockwise motion of the input gear assembly 10 rotates the output gear assembly 15 in a counterclockwise motion. The actuator arm 24 is operatively coupled to the output gear assembly 15 in such a way that the counterclockwise motion of the output gear assembly 15 applies a downward force to the actuator arm 24. The toilet handle connector 28 is terminally engaged with the actuator arm 24 as the free end of the toilet handle is attached to the toilet handle. As a result of the downward force of the actuator arm 24, the toilet handle connector 28 moves toward the bathroom floor and pulls the toilet handle downward thus flushing the toilet.

Figure 5:
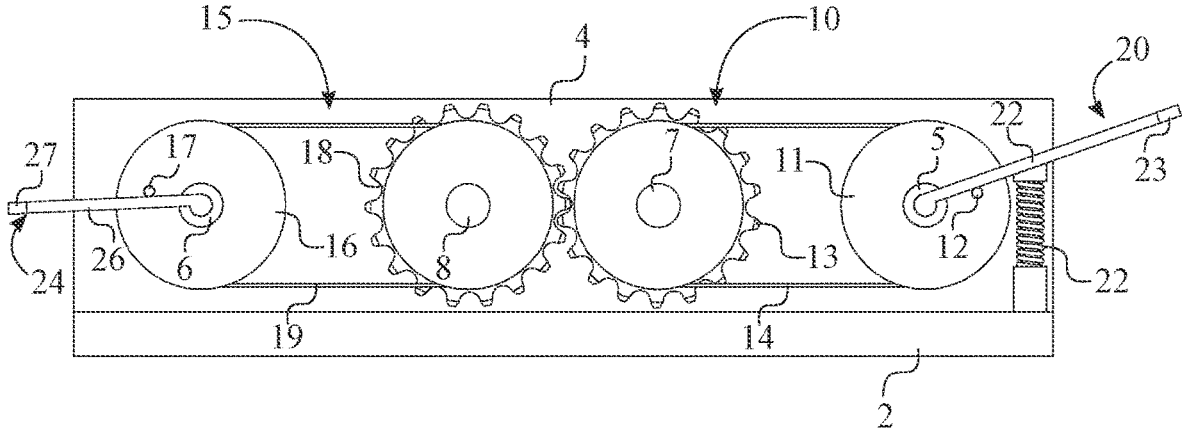
FIG. 5 is a side view of the present invention without the toilet handle connector and the cover.
Figure 6:
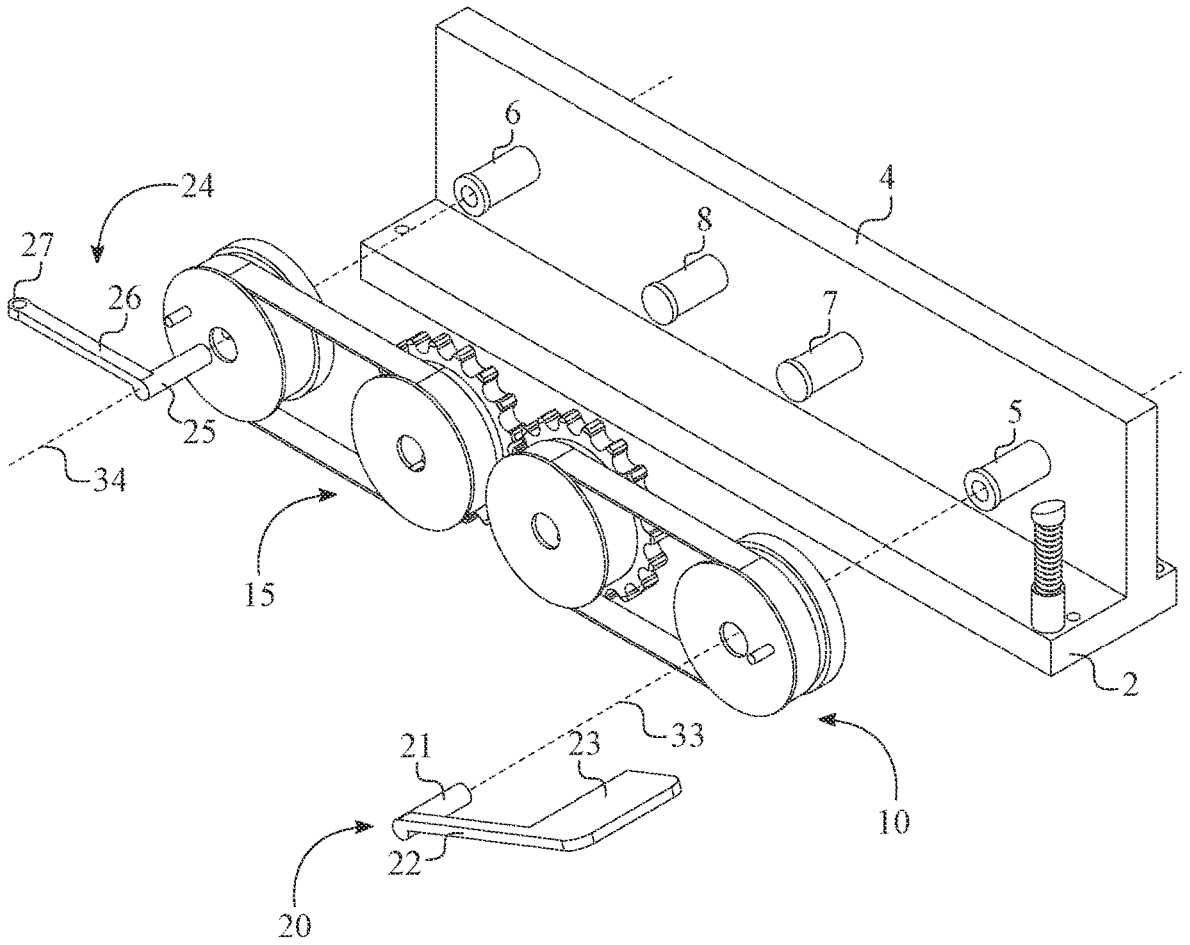
FIG. 6 is an exploded view of the present invention without the toilet handle connector and the cover, showing the first rotational axis and the second rotational axis.

In reference to FIG. 5 and FIG. 6, the mounting bracket 1 further comprises a first gear mount 5, a second gear mount 6, a third gear mount 7, and a fourth gear mount 8. More specifically, the base member 2 is flat surface area so that the wall member 4 can be perpendicularly connected onto the base member 2. When the present invention is operational, the base member 2 is attached onto the bathroom floor so that the wall member 4 can maintain a perpendicular positioning to the bathroom floor. The first gear mount 5, the second gear mount 6, the third gear mount 7, and the fourth gear mount 8 are linearly positioned along the wall member 4 and perpendicularly connected to the wall member 4. More specifically, the first gear mount 5 and the third gear mount 7 are linearly positioned adjacent to each other. The fourth gear mount 8 is linearly positioned adjacent to the third gear mount 7 and positioned opposite of the first gear mount 5. The second gear mount 6 is linearly positioned adjacent to the fourth gear mount 8 and positioned opposite of the third gear mount 7. The first gear mount 5, the second gear mount 6, the third gear mount 7, and the fourth gear mount 8 are shaped into a cylindrical bodies so that the input gear assembly 10 and the output gear assembly 15 can rotate about the wall member 4. More specifically, the input gear assembly 10 is rotatably connected to the wall member 4 through the first gear mount 5 and the third gear mount 7. The output gear assembly 15 is rotatably connected to the wall member 4 through the second gear mount 6 and the fourth gear mount 8.

Figure 4:
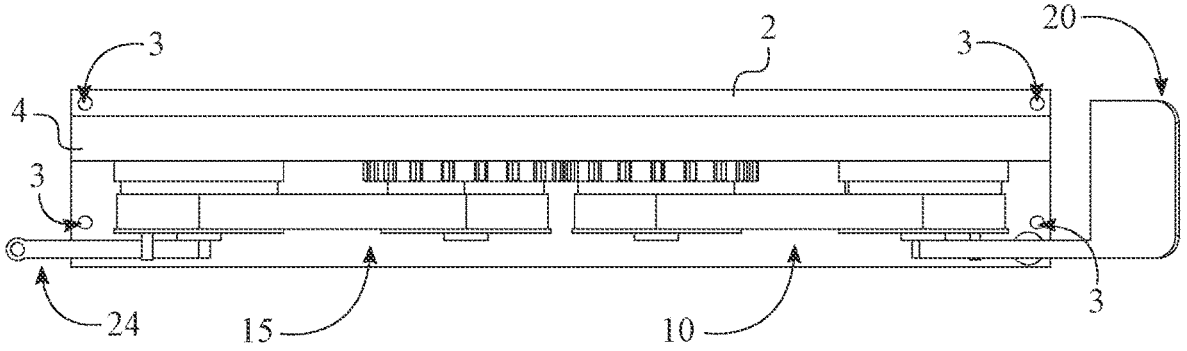
FIG. 4 is a top view of the present invention without the toilet handle connector and the cover.

In reference to FIG. 4, the mounting bracket 1 further comprises a plurality of fastener openings 3. More specifically, the plurality of fastener openings 3 is perimetrically positioned around the base member 2 and traverses through the base member 2. The plurality of fastening openings allows the user to fasten the mounting bracket 1 to the bathroom floor via screw fastener or any other type of fasteners. Even though the plurality of fastener openings 3 is utilized within the preferred embodiment of the mounting bracket 1, the present invention can utilize any other types of fastening mechanisms (adhesive, fastening tabs, and fastening brackets) to fasten the mounting bracket 1 to the bathroom floor without deviating from the scope of the functionality.

Figure 9:
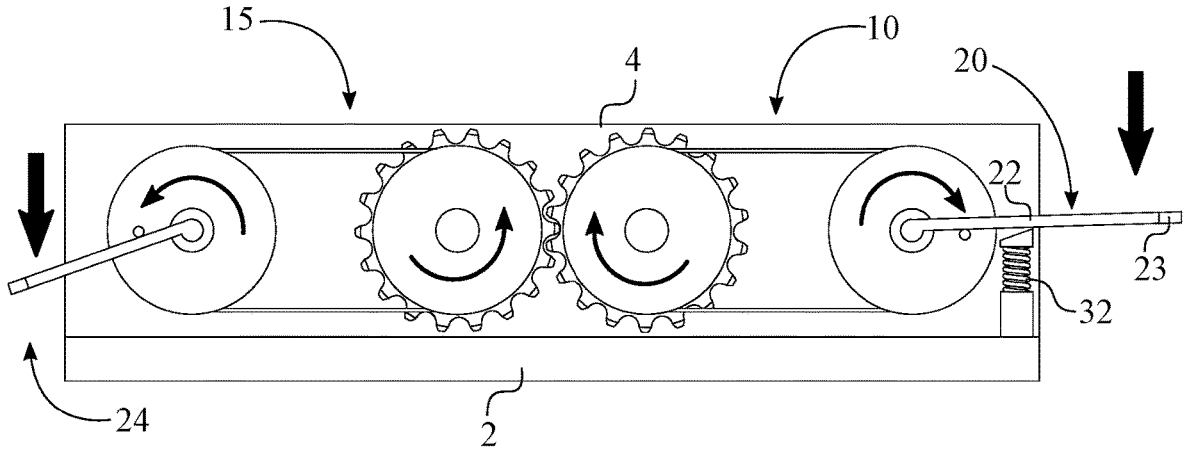
FIG. 9 is a side view of the present invention without the toilet handle connector and the cover, showing the downward movement of the flush pedal, clockwise motion of the input gear assembly, counterclockwise motion of the output gear assembly, and the downward movement of the actuator arm.

In reference to FIG. 5 and FIG. 9, the input gear assembly 10 comprises an input pulley 11, an input brace 12, an input gear 13, and a first belt 14. The input gear assembly 10 functions as the foot-operated single pedal system so that the user can activate the present invention. More specifically, the input pulley 11 is rotatably connected to the first gear mount 5. The input brace 12 is perpendicularly connected to the input pulley 11 and outwardly extended from an outer face of the input pulley 11. The input gear 13 is rotatably connected to the third gear mount 7 and linearly offset from the input pulley 11. The first belt 14 is tensionally looped around the input pulley 11 and the input gear 13 so that the rotational force of the input pulley 11 can be transferred to the input gear 13. In other words, the flush pedal 20 is pressed by the user, the flush pedal 20 rotates the input pulley 11 in the clockwise motion. Simultaneously, the input gear 13 is also rotated in the clockwise motion due to the looped connection of the first belt 14.

Figure 7:
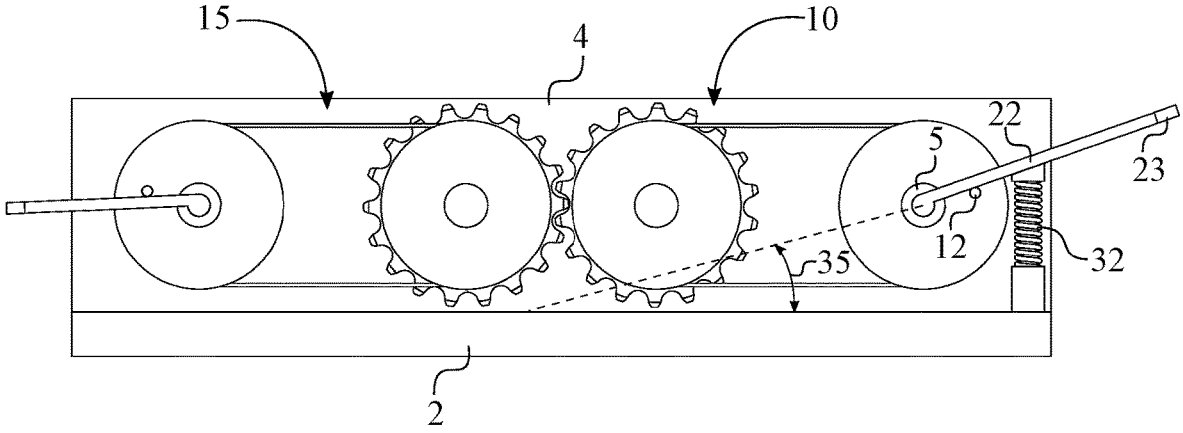
FIG. 7 is a side view of the present invention without the toilet handle connector and the cover, showing the acute angle between the base member and the flush pedal.

In reference to FIG. 6 and FIG. 9, the present invention further comprises a first rotational axis 33 that allows the flush pedal 20 to rotate about. The flush pedal 20 comprises a head 21, an extension rod 22, and a pedal body 23 so that the input pulley 11 can be rotated with respect to the preferred embodiment. The first rotational axis 33 is concentrically positioned along the first gear mount 5 and positioned perpendicular to the wall member 4. The head 21 is adjacently connected to the extension rod 22. The pedal body 23 is adjacently connected to the extension rod 22 and positioned opposite of the head 21. In order for the flush pedal 20 to be operatively engaged with the input gear assembly 10, the head 21 of the flush pedal 20 is rotatably connected to the first gear mount 5 and concentrically positioned along the first rotational axis 33. The extension rod 22 of the flush pedal 20 is outwardly extended from the first gear mount 5 and slidably engaged with the input brace 12. Furthermore, the extension rod 22 of the flush pedal 20 is angularly positioned to the base member 2 at an acute angle 35, as shown in FIG. 7. Resultantly, the pedal body 23 of the flush pedal 20 is externally positioned to the mounting bracket 1 so that the user can step on the pedal body 23 to activate the present invention. Once the pedal body 23 is pressed downward, the extension rod 22 pushes down on the input brace 12 thus rotating the input pulley 11 in the clockwise motion. As mentioned before, the input gear 13 is also simultaneously rotated in the clockwise motion due to the looped connection of the first belt 14.

In reference to FIG. 5, the present invention further comprises a compression spring 32 so that the flush pedal 20 can be shifted back to the initial positioning. More specifically, the compression spring 32 is positioned in between the base member 2 and the extension rod 22 of the flush pedal 20. A proximal end of the compression spring 32 is mounted onto the base member 2, and the extension rod 22 of the flush pedal 20 is mounted onto a distal end of the compression spring 32. In other words, the compression spring 32 is mounted in between the base member 2 and the extension rod 22 so that the flush pedal 20 can be pushed back to the initial positioning after user's foot is removed from the flush pedal 20. Even though the compression spring 32 is utilized as the preferred component to push back the flush pedal 20 to the initial positioning, any other type of mechanical apparatus (ex: a tension spring or spring loaded system) can be utilized within the present invention to attain the same functionality.

In reference to FIG. 5 and FIG. 9, the output gear assembly 15 comprises an output pulley 16, an output brace 17, an output gear 18, and a second belt 19. The output gear assembly 15 transfers the kinetic energy of the input gear assembly 10 so that the actuator arm 24 can pull down on the toilet handle connector 28 to flush the toilet. More specifically, the output pulley 16 is rotatably connected to the second gear mount 6. The output brace 17 is perpendicularly connected to the output pulley 16 and outwardly extended from an outer face of the output pulley 16. The output gear 18 is rotatably connected to the fourth gear mount 8 and linearly offset from the output pulley 16. The second belt 19 is tensionally looped around the output pulley 16 and the output gear 18 so that the rotational force of the output pulley 16 can be transferred to the output gear 18. In other words, the clockwise motion of the input gear 13 rotates the output gear 18 in the counterclockwise motion. Simultaneously, the output pulley 16 is also rotated in the counterclockwise motion due to the looped connection of the second belt 19.

As shown in FIG. 5, FIG. 6, and FIG. 9, the present invention is able to complete the energy transferring between the input gear assembly 10 and the output gear assembly 15 due to the adjacent positioning of the input gear 13 and the out gear. More specifically, the input gear 13 is rotatably engaged with the output gear 18 as the input gear 13 and the output gear 18 are rotated in opposite direction.

In reference to FIG. 6 and FIG. 9, the present invention further comprises a second rotational axis 34 that allows the actuator arm 24 to rotate about. The actuator arm 24 comprises a head 25, an extension rod 26, and an adaptor 27 so that the output pulley 16 can control the angular movement of actuator arm 24 with respect to the preferred embodiment. The second rotational axis 34 is concentrically positioned along the second gear mount 6 and positioned perpendicular to the wall member 4. The head 25 is adjacently connected to the extension rod 26. The adaptor 27 is adjacently connected to the extension rod 26 and positioned opposite of the head 25. In order for the actuator arm 24 to be operatively engaged with the output gear assembly 15, the head 25 of the actuator arm 24 is rotatably connected to the second gear mount 6 and concentrically positioned along the second rotational axis 34. The extension rod 26 of the actuator arm 24 is outwardly extended from the second gear mount 6 and slidably engaged with the output brace 17. Resultantly, the adaptor 27 of the actuator arm 24 is externally positioned to the mounting bracket 1 so that the toilet handle connector 28 can be attached. Once the clockwise motion of the input gear 13 rotates the output gear 18 in the counterclockwise motion, the output pulley 16 is also simultaneously rotated in the counterclockwise motion due to the looped connection of the second belt 19. Then, the output brace 17 is able to push down on the extension rod 26 thus rotating the actuator arm 24 downward and toward the bathroom floor.

Figure 8:
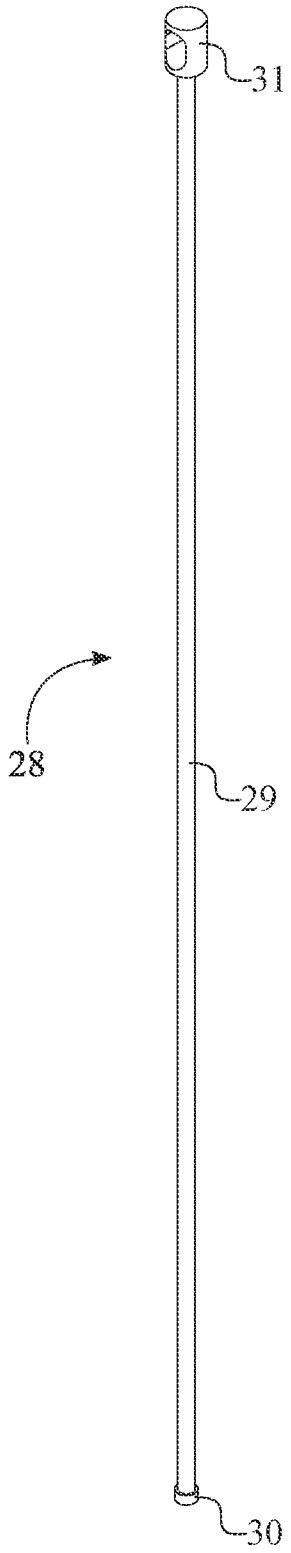
FIG. 8 is a perspective view of the toilet handle connector of the present invention.

In reference to FIG. 8, the toilet handle connector 28 comprises an elongated member 29, an actuator attachment 30, and a toilet handle attachment 31. More specifically, the actuator attachment 30 is adjacently connected to the elongated member 29. The toilet handle attachment 31 is adjacently connected to the elongated member 29, opposite of the actuator attachment 30. The actuator attachment 30 is engaged with the adaptor 27 of the actuator arm 24 so that the elongated member 29 can oriented upward from the bathroom floor. Then, the user can attach the toilet handle attachment 31 to the toilet handle. Once the present invention is operatively coupled to the toilet handle, the downward rotation of the actuator arm 24 pulls down the toilet handle connector 28 which in return pulls down the toilet handle that flushes the toilet.

In reference to FIG. 1, FIG. 2, and FIG. 6, the present invention further comprises a cover 9 so that majority of the components can be protected from outside elements. More specifically, the cover 9 is externally mounted to the base member 2 as the input gear assembly 10 and the output gear assembly 15 are enclosed within the cover 9. The extension rod 22 of the flush pedal 20 traverses through the cover 9 so that the pedal body 23 of the flush pedal 20 can be externally positioned to the cover 9. The extension rod 26 of the actuator arm 24 traverses through the cover 9 so that the adaptor 27 of the actuator arm 24 can be externally positioned to the cover 9.

Although the invention has been explained in relation to its preferred embodiment, it is to be understood that many other possible modifications and variations can be made without departing from the spirit and scope of the invention as hereinafter claimed.

What is claimed is:

1. A hands-free toilet flushing apparatus comprising:

a mounting bracket;

an input gear assembly;

an output gear assembly;

a flush pedal;

an actuator arm;

a toilet handle connector;

the mounting bracket comprising a base member, a wall member, a first gear mount, a second gear mount, a third gear mount, and a fourth gear mount;

the wall member being perpendicularly connected to the base member;

the input gear assembly being rotatably connected to the wall member;

the output gear assembly being rotatably connected to the wall member;

the flush pedal being operatively coupled to the input gear assembly, wherein the downward movement of the flush pedal rotates the input gear assembly in a clockwise motion;

the output gear assembly being rotatably engaged with the input gear assembly, wherein the clockwise motion of the input gear assembly rotates the output gear assembly in a counterclockwise motion;

the actuator arm being operatively coupled to the output gear assembly, wherein the counterclockwise motion of the output gear assembly applies a downward force to the actuator arm;

the toilet handle connector being terminally engaged with the actuator arm;

the first gear mount, the second gear mount, the third gear mount, and the fourth gear mount being linearly positioned along the wall member;

the first gear mount, the second gear mount, the third gear mount, and the fourth gear mount being perpendicularly connected to the wall member;

the input gear assembly being rotatably connected to the wall member through the first gear mount and the third gear mount; and the output gear assembly being rotatably connected to the wall member through the second gear mount and the fourth gear mount.

2. The hands-free toilet flushing apparatus as claimed in claim 1 comprising:

the mounting bracket further comprising a plurality of fastener openings;

the plurality of fastener openings being perimetrically positioned around the base member; and the plurality of fastener openings traversing through the base member.

3. The hands-free toilet flushing apparatus as claimed in claim 1 comprising:

the input gear assembly comprising an input pulley, an input brace, an input gear, and a first belt;

the input pulley being rotatably connected to the first gear mount;

the input brace being perpendicularly connected to the input pulley;

the input gear being rotatably connected to the third gear mount; and the first belt being tensionally looped around the input pulley and the input gear.

4. The hands-free toilet flushing apparatus as claimed in claim 3 comprising:

a first rotational axis;

the flush pedal comprising a head, an extension rod, and a pedal body;

the first rotational axis being concentrically positioned along the first gear mount;

the head being adjacently connected to the extension rod;

the pedal body being adjacently connected to the extension rod, opposite of the head;

the head of the flush pedal being rotatably connected to the first gear mount;

the head of the flush pedal being concentrically positioned along the first rotational axis;

the extension rod of the flush pedal being outwardly extended from the first gear mount;

the extension rod of the flush pedal being slidably engaged with the input brace;

the extension rod of the flush pedal being angularly positioned to the base member at an acute angle; and the pedal body of the flush pedal being externally positioned to the mounting bracket.

5. The hands-free toilet flushing apparatus as claimed in claim 4 comprising:

a compression spring;

the compression spring being positioned in between the base member and the extension rod of the flush pedal;

the compression spring being mounted onto the base member; and the extension rod of the flush pedal being mounted onto the compression spring.

6. The hands-free toilet flushing apparatus as claimed in claim 1 comprising:

the output gear assembly comprising an output pulley, an output brace, an output gear, and a second belt;

the output pulley being rotatably connected to the second gear mount;

the output brace being perpendicularly connected to the output pulley;

the output gear being rotatably connected to the fourth gear mount; and the second belt being tensionally looped around the output pulley and the output gear.

7. The hands-free toilet flushing apparatus as claimed in claim 6 comprising:

a second rotational axis;

the actuator arm comprising a head, an extension rod, and an adaptor;

the second rotational axis being concentrically positioned along the second gear mount;

the head being adjacently connected to the extension rod;

the adaptor being adjacently connected to the extension rod, opposite of the head;

the head of the actuator arm being rotatably connected to the second gear mount;

the head of the actuator arm being concentrically positioned along the second rotational axis;

the extension rod of the actuator arm being outwardly extended from the second gear mount;

the extension rod of the actuator arm being slidably engaged with the output brace; and the adaptor of the actuator arm being externally positioned to the mounting bracket.

8. The hands-free toilet flushing apparatus as claimed in claim 1 comprising:

the input gear assembly comprising an input gear;

the output gear assembly comprising an output gear;

the input gear being adjacently positioned to the output gear; and the input gear being rotatably engaged with the output gear.

9. The hands-free toilet flushing apparatus as claimed in claim 1 comprising:

the toilet handle connector comprising an elongated member, an actuator attachment, and a toilet handle attachment;

the actuator attachment being adjacently connected to the elongated member;

the toilet handle attachment being adjacently connected to the elongated member, opposite of the actuator attachment; and the actuator attachment being engaged with an adaptor of the actuator arm.

10. The hands-free toilet flushing apparatus as claimed in claim 1 comprising:

a cover;

the cover being externally mounted to the base member;

the input gear assembly and the output gear assembly being enclosed by the cover;

an extension rod of the flush pedal traversing through the cover;

a pedal body of the flush pedal being externally positioned to the cover;

an extension rod of the actuator arm traversing through the cover; and an adaptor of the actuator arm being externally positioned to the cover.

11. A hands-free toilet flushing apparatus comprising:

a mounting bracket;

an input gear assembly;

an output gear assembly;

a flush pedal;

an actuator arm;

a toilet handle connector;

a cover;

the mounting bracket comprising a base member, a wall member, a first gear mount, a second gear mount, a third gear mount, and a fourth gear mount;

the wall member being perpendicularly connected to the base member;

the input gear assembly being rotatably connected to the wall member;

the output gear assembly being rotatably connected to the wall member;

the flush pedal being operatively coupled to the input gear assembly, wherein the downward movement of the flush pedal rotates the input gear assembly in a clockwise motion;

the output gear assembly being rotatably engaged with the input gear assembly, wherein the clockwise motion of the input gear assembly rotates the output gear assembly in a counterclockwise motion;

the actuator arm being operatively coupled to the output gear assembly, wherein the counterclockwise motion of the output gear assembly applies a downward force to the actuator arm;

the toilet handle connector being terminally engaged with the actuator arm;

the cover being externally mounted to the base member;

the input gear assembly and the output gear assembly being enclosed by the cover;

the first gear mount, the second gear mount, the third gear mount, and the fourth gear mount being linearly positioned along the wall member;

the first gear mount, the second gear mount, the third gear mount, and the fourth gear mount being perpendicularly connected to the wall member;

the input gear assembly being rotatably connected to the wall member through the first gear mount and the third gear mount; and the output gear assembly being rotatably connected to the wall member through the second gear mount and the fourth gear mount.

12. The hands-free toilet flushing apparatus as claimed in claim 11 comprising:

the mounting bracket further comprising a plurality of fastener openings;

the plurality of fastener openings being perimetrically positioned around the base member; and the plurality of fastener openings traversing through the base member.

13. The hands-free toilet flushing apparatus as claimed in claim 11 comprising:

the input gear assembly comprising an input pulley, an input brace, an input gear, and a first belt;

the input pulley being rotatably connected to the first gear mount;

the input brace being perpendicularly connected to the input pulley;

the input gear being rotatably connected to the third gear mount; and the first belt being tensionally looped around the input pulley and the input gear.

14. The hands-free toilet flushing apparatus as claimed in claim 13 comprising:

a first rotational axis;

the flush pedal comprising a head, an extension rod, and a pedal body;

the first rotational axis being concentrically positioned along the first gear mount;

the head being adjacently connected to the extension rod;

the pedal body being adjacently connected to the extension rod, opposite of the head;

the head of the flush pedal being rotatably connected to the first gear mount;

the head of the flush pedal being concentrically positioned along the first rotational axis;

the extension rod of the flush pedal being outwardly extended from the first gear mount;

the extension rod of the flush pedal being slidably engaged with the input brace;

the extension rod of the flush pedal being angularly positioned to the base member at an acute angle;

the pedal body of the flush pedal being externally positioned to the mounting bracket;

the extension rod of the flush pedal traversing through the cover; and the pedal body of the flush pedal being externally positioned to the cover.

15. The hands-free toilet flushing apparatus as claimed in claim 14 comprising:

a compression spring;

the compression spring being positioned in between the base member and the extension rod of the flush pedal;

the compression spring being mounted onto the base member; and the extension rod of the flush pedal being mounted onto the compression spring.

16. The hands-free toilet flushing apparatus as claimed in claim 11 comprising:

the output gear assembly comprising an output pulley, an output brace, an output gear, and a second belt;

the output pulley being rotatably connected to the second gear mount;

the output brace being perpendicularly connected to the output pulley;

the output gear being rotatably connected to the fourth gear mount; and the second belt being tensionally looped around the output pulley and the output gear.

17. The hands-free toilet flushing apparatus as claimed in claim 16 comprising:

a second rotational axis;

the actuator arm comprising a head, an extension rod, and an adaptor;

the second rotational axis being concentrically positioned along the second gear mount;

the head being adjacently connected to the extension rod;

the adaptor being adjacently connected to the extension rod, opposite of the head;

the head of the actuator arm being rotatably connected to the second gear mount;

the head of the actuator arm being concentrically positioned along the second rotational axis;

the extension rod of the actuator arm being outwardly extended from the second gear mount;

the extension rod of the actuator arm being slidably engaged with the output brace;

the adaptor of the actuator arm being externally positioned to the mounting bracket;

the extension rod of the actuator arm traversing through the cover; and the adaptor of the actuator arm being externally positioned to the cover.

18. The hands-free toilet flushing apparatus as claimed in claim 11 comprising:

the input gear assembly comprising an input gear;

the output gear assembly comprising an output gear;

the toilet handle connector comprising an elongated member, an actuator attachment, and a toilet handle attachment;

the input gear being adjacently positioned to the output gear;

the input gear being rotatably engaged with the output gear;

the actuator attachment being adjacently connected to the elongated member;

the toilet handle attachment being adjacently connected to the elongated member, opposite of the actuator attachment; and the actuator attachment being engaged with an adaptor of the actuator arm.

* * * * *